United States Patent [19]

Katzman et al.

[11] 3,953,027

[45] Apr. 27, 1976

[54] CARD MATCHING APPARATUS INCLUDING DISPENSER

[75] Inventors: Allison W. Katzman, Chicago; Gordon A. Barlow, Skokie, both of Ill.

[73] Assignee: Marvin Glass & Associates, Chicago, Ill.

[22] Filed: Feb. 12, 1975

[21] Appl. No.: 549,433

[52] U.S. Cl. ..... 273/1 R; 273/148 R; 273/135 R

[51] Int. Cl.[2] ..... A63F 9/00

[58] Field of Search ..... 273/1 R, 1 E, 135, 148 R

[56] References Cited

UNITED STATES PATENTS

| | | | |
|---|---|---|---|
| 2,615,718 | 10/1952 | Robbins | 273/144 A |
| 3,441,280 | 4/1969 | Eggermont | 273/135 B |
| 3,582,075 | 6/1971 | Glass | 273/1 R |
| 3,592,472 | 7/1971 | Kent | 273/136 C |
| 3,845,958 | 11/1974 | Reinertsen | 273/144 R |

*Primary Examiner*—Richard J. Apley
*Assistant Examiner*—Marvin Siskind
*Attorney, Agent, or Firm*—Coffee & Sweeney

[57] ABSTRACT

A game apparatus for use by two or more players. The game apparatus includes a set of playing cards having different indicia on at least some of the cards, and a set of chips having indicia on at least some of the chips which is identical to the indicia on one of the playing cards for matching with the cards during the play of the game. The game includes a chip dispenser for dispensing one of the chips successively to the players of the game from a stack of chips the order of which is unobservable by the players. The chips are "purchased" with one of a plurality of simulated coins which are acquired by the players according to the dictates of the game. The dispensing device is in the form of a toy truck and includes a signalling device which produces an audible signal when one of the coins is inserted through a slot in the top of the toy truck.

9 Claims, 5 Drawing Figures

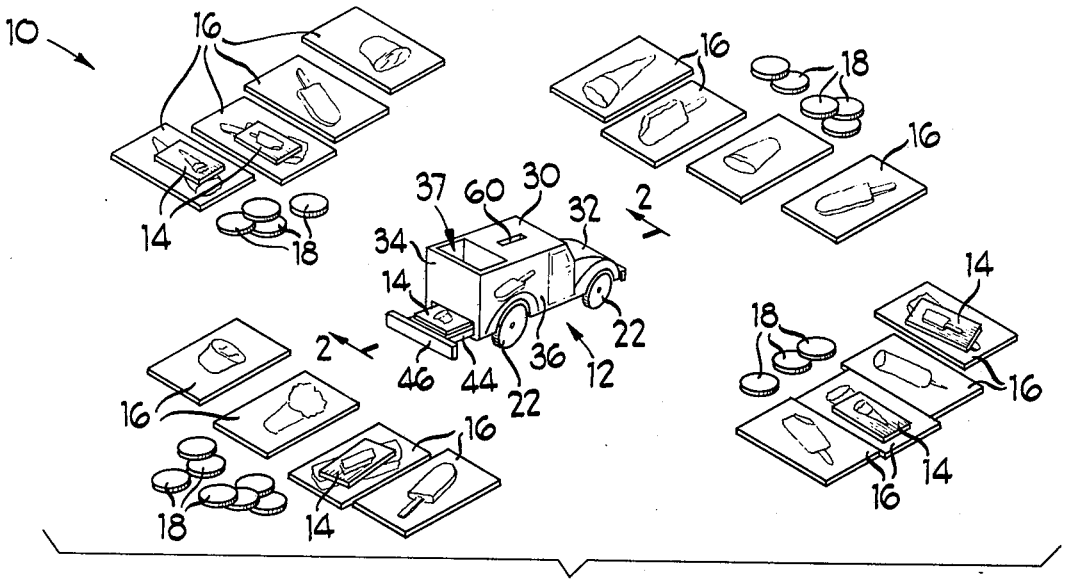
Fig 1
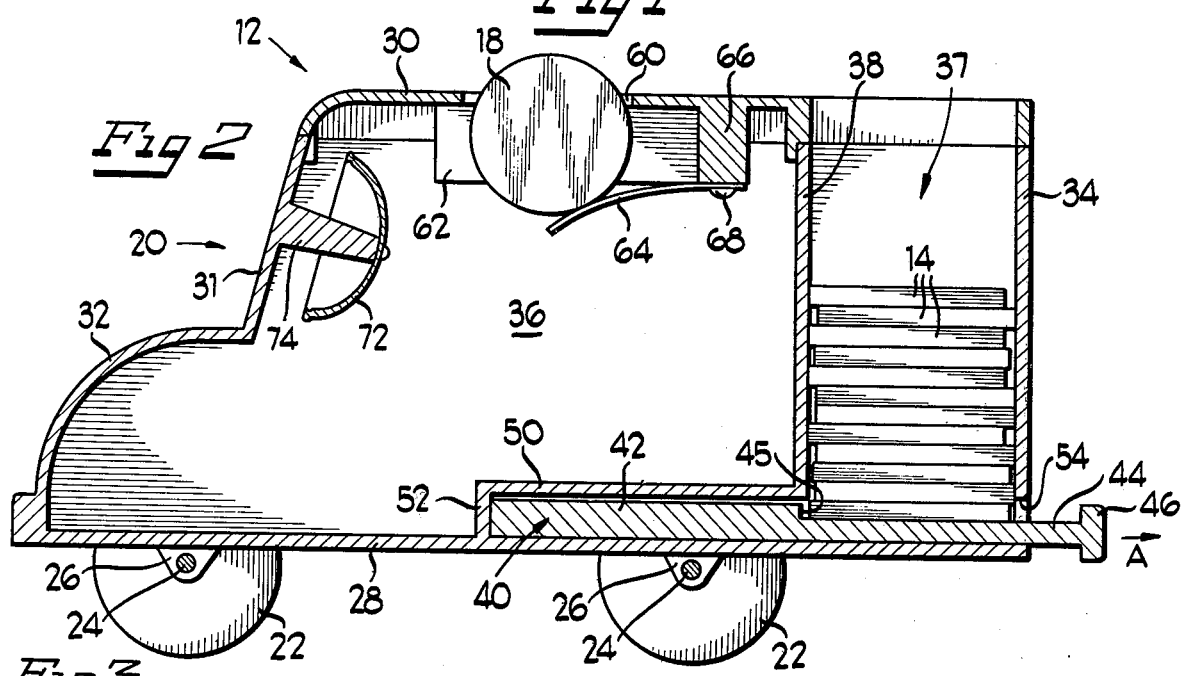
Fig 2
Fig 3
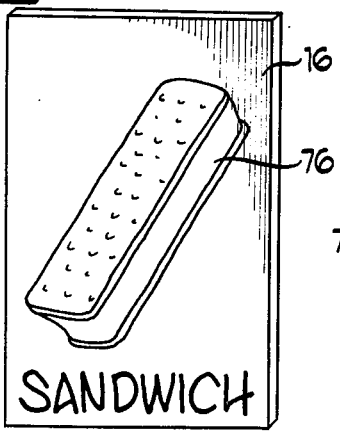
Fig 4
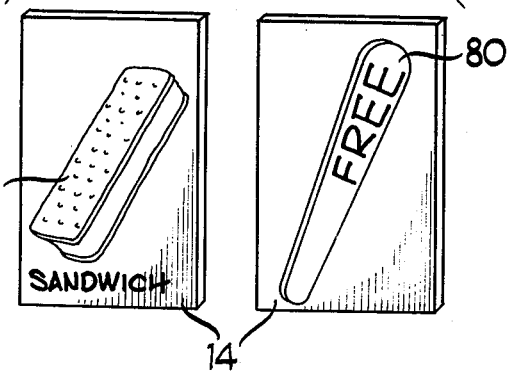
Fig 5
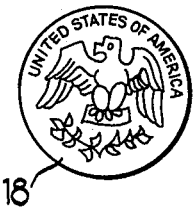

CARD MATCHING APPARATUS INCLUDING DISPENSER

BACKGROUND AND SUMMARY OF THE INVENTION

This invention relates to a game apparatus and more particularly to a game apparatus involving chance as well as judgment of the players.

Many games, including card games, have been provided for use by preschool age children. However, since children of this age normally have a considerably short attention span it has often been found necessary to include interesting, particularly known objects associated with the game in order to keep a child's attention throughout the play of the game, as well as involving some degree of judgment.

It is an object of the present invention to provide a new and interesting game combination or apparatus which is capable of keeping a child's attention in order to complete the play of the game.

The game of the present invention includes a plurality of playing cards each of which includes indicia representative of a "treat," for example an ice cream bar, cone, sandwich, or the like, of varying flavors. The game apparatus includes a similar plurality of chips each of which has indicia identical to that on one of the playing cards so that they can be matched to form pairs. A plurality of simulated coins are used to purchase the varying chips from a dispensing device. The dispensing device is in the shape of an ice cream dispensing truck and includes a manually actuated drawer on its rearward end for dispensing one of the chips from a stack of which are stored therein. A slot is provided on the top of the truck for receiving one of the coins required to make a "purchase" of a chip. Signal means within the truck produces an audible signal as the coin is received. When a child's issued playing cards are covered by purchased chips, without running out of issued coins, he or she wins the game in accordance with the dictates of the game rules.

Other objects, features and advantages of the invention will be apparent from the following detailed description taken in connection with the accompanying drawings.

BRIEF DESCRIPTION OF THE DRAWINGS

FIG. 1 is a perspective view of some of the components comprising the game apparatus or combination of the present invention;

FIG. 2 is a vertical section, on an enlarged scale, of the toy truck dispensing device taken generally along the line 2—2 of FIG. 1;

FIG. 3 is a perspective view, on an enlarged scale, of one of the playing cards of the present invention;

FIG. 4 is a perspective view, on an enlarged scale, of two of the playing chips of the present invention; and FIG. 5 is a plan view, on an enlarged scale, of one of the plurality of coins used with the present invention.

DESCRIPTION OF THE PREFERRED EMBODIMENT

FIG. 1 of the drawings shows the game apparatus or combination, generally designated 10, of the present invention as it can be used by four players of the game. The individual components of the game are shown and described with reference to the remaining figures. FIG. 2 shows the dispensing device, generally designated 12, which is used for "randomly" dispensing one of a plurality of playing chips, generally designated 14 (FIG. 4) from a stack thereof. In other words, the order of the chips in the stack are unobservable to the players of the game. The game 10 includes a plurality of playing cards 16 which are matched by means of indicia with the chips 14. One of the cards 16 is shown in FIG. 3. The game 10 also includes a plurality of simulated coins 18, shown in FIG. 5, which are used to "purchase" the chips 14 from the dispensing device 12, as will be described in greater detail hereinafter.

Referring more particularly to FIG. 2, the dispensing device 12 is made in the form and shape of a toy ice cream dispensing truck. The truck includes a body portion 20 which is supported by four rotatably mounted wheels 22. The wheels 22, on opposite sides of the truck, are mounted on an axle 24 which is rotatably mounted to depending tabs 26.

The body portion of the truck 20 is mounted on a base or chassis 28 and includes a removable top or roof 30, a windshield 31 and a hood 32. The body 20 also includes a rear wall 34 and side walls 36 which conform to the profile described by the roof 30, windshield 31 and hood 32. A generally hollow, rear cavity, generally designated 37, is provided forwardly of the rear wall 34 by the side walls 36 and an intermediate web or wall 38. The chips 14 are stacked on top of one another and placed within the rear compartment 37 to be dispensed, one at a time, by dispensing means, generally designated 40.

The dispensing means 40 comprises a "drawer" which is formed by a generally flat plate 42. The rearwardmost portion of the plate 42 is reduced to provide a substantially thinner portion 44 which may be approximately half the thickness of the forward portion 42 to define a shoulder 45 therebetween. The height of shoulder 45 is less than the thickness of one of the chips 14 so as to remove only a single chip. The dispensing means or drawer 40 is mounted below the compartment 37 for dispensing the chips 14. A simulated bumper 46 is attached to the rearwardmost end of the reduced portion 44 to facilitate manual grasping and outward pulling movement of the drawer 40 in the direction of arrow A in FIG. 2 to dispense a single chip 14 by abutment with the shoulder 45. The drawer 40 is supported on the chassis 28 with the forwardmost end thereof being enclosed within a recess formed by a horizontal baffle plate 50 and a short vertical baffle plate 52 formed integrally with the side walls 36. The rearward end of the drawer 40 extends through an aperture 54 formed in the lowermost portion of the rear wall 34 to facilitate manual grasping by a player. As the drawer 40 is moved inwardly through the aperture 54 one of the chips 14 stacked within the compartment 37 will fall down onto the reduced portion 44 of the drawer due to the influence of gravity. The chip 14 then is dispensed as the drawer is manually pulled outward in the direction of arrow A so that it can be picked up by one of the players. Stop means (not shown) may be provided in the form of a shoulder or detent on the drawer 40 to prevent the drawer from being totally withdrawn from the vehicle. The thickened area 42 of the drawer 40 supports the remaining chips within the compartment so that as the drawer is moved back into a receiving position the next adjacent chip will drop down onto the drawer 40.

Referring now to the top 30 of the truck 12, a slot 60 is provided therein for placing the coins 18 into the truck 12. According to the rules of the game, which will be described below, each chip 14 is "purchased" from the dispensing device by a player as the player places one of his coins through the slot 60. A pair of depending longitudinal flanges 62 (FIG. 2) are provided on the inside of the top wall 30 on both sides of the slot 60 to maintain alignment of the coin as it is inserted through the slot. A small leaf spring 64 is provided below the slot with one end secured to a post or a flange 66 at the rearwardmost end of the flanges 62 by a screw 68 so that as the coin is pushed downwardly the spring 64 causes the coin to be impelled forwardly within the truck body 20.

Signal means in the form of a bell 72 is mounted interiorly and forwardly of the slot 60. The bell 72 is supported on the interior of the windshield 31 by a mounting post 74 so that, as the coin is impelled forward by the spring 64, it will impinge the bell 72 and cause an audible signal to be given to the players of the game to signal that a coin has been received by the dispensing device and that one of the chips 14 has been purchased.

The coins can be retrieved from the dispensing device by removing the roof 30. Each of the playing cards 16 carries indicia 76 representative of an ice cream cone, bar, sandwich, or the like. Similarly, at least some of the playing chips 14, also are provided with indicia 78 which is identical to the indicia carried by one of the cards 16. The object of the game is for each of the players to match the indicia 76 on his cards 16 with the indicia 78 on the chips 14. One or more of the playing chips 14 include "free" indicia 80 (FIG. 4) which indicates that that chip is a "wild card" and will automatically match, or make a pair with the indicia 76 on any one of the player's cards 16.

Two or more players can participate in the play of the game. Initially, in one scheme of play, each of the players is given a plurality (e.g., six) of the coins 18 and dealt a plurality (e.g., four) of the cards 16 which are placed face up in front of him. One of the players is chosen to be the first player to begin the game by a chance device or other conventional means. The first player places one of his coins through the slot in the top of the truck which permits him to take one of the chips 14. If the indicia 78 on the chip 14 matches the indicia 76 on any one of his playing cards 16 he places that chip on top of that card and it becomes the next player's turn. However, if the indicia 78 on the player's chip 14 does not match any of the indicia 76 on one of his cards 16, he may place that chip back into the compartment 37 or sell it to one of the other players for two coins. If he decides to sell the chip 14 to another player he may offer it to the players in their order of playing the game beginning with the player at the left, for instance. As described, at least one of the chips 14 includes indicia 80 (FIG. 4) which indicates that that is a free or wild card chip which may be placed on any one of his cards to form a match. The free or wild card chip may be required to be used immediately and cannot be moved to another card during the play of the game. If a player should run out of coins, he may sell, on his turn, one of his chips for one or more coins, again offering it to the other players beginning in a selected order or randomly. The player to match all of his cards 16 with chips 14 is declared the winner of the game.

It should be understood that, as used in the claims hereof, the terms "different configuration" between the set of cards 14 and the set of cards 16 not only is meant to include similarly shaped but different sized cards as shown herein, but different shaped playing pieces as well as other differing characteristics as long as the indicia on the respective two sets of playing pieces can be matched by the players, particularly children, and that the one set of playing pieces is capable of being dispensed by the dispenser (i.e., the toy vehicle 12). In addition, the use in this specification and in the claims of "ice cream" type indicia is intended to include all of those types of products normally dispensed by a common "ice cream truck," such as popsicles, although the item actually does not include ice cream.

The foregoing detailed description has been given for clearness of understanding only and no unnecessary limitations should be understood therefrom as some modifications will be obvious to those skilled in the art.

We claim:

1. A game apparatus comprising, in combination:

a first set of playing pieces distributable in given numbers to plural players of the game, with different indicia on at least some of said first set of playing pieces;

a second set of playing pieces being visually distinguishable from said first set of playing pieces, with indicia on at least some of said second set of playing pieces corresponding to the indicia on said first set of playing pieces whereby the players attempt to match one of the second set of playing pieces with one of the first set of playing pieces;

a dispensing device for holding a plurality of said second set of playing pieces and a manually actuatable member movable between a receiving and dispensing position for dispensing the playing pieces only one at a time; and a plurality of payment playing pieces disposable into said dispensing device by the players of the game in payment for one of said second set of playing pieces.

2. The game combination of claim 1 wherein said payment playing pieces are in the form of simulated coins disposable into a slot in said dispensing device.

3. The game combination of claim 1 wherein said dispensing device is in the form of a toy vehicle.

4. The game combination of claim 3 wherein the corresponding indicia on said first and second set of playing pieces is in the form of "ice cream" type items and said toy vehicle is in the form of a truck having ice cream type indicia thereon similar to that on the playing pieces.

5. The game combination of claim 1 wherein said dispensing device has a vertical compartment for receiving and supporting a stack of said second set of playing pieces placed therein, and including ejecting means comprising a manually movable slide for removing the playing pieces only one at a time from the bottom of the stack thereof.

6. A game apparatus comprising, in combination:

a first set of playing pieces distributable in given numbers to plural players of the game, with different indicia on at least some of said first set of playing pieces;

a second set of playing pieces being visually distinguishable from said first set of playing pieces, with indicia on at least some of said second set of playing pieces corresponding to the indicia on said first set of playing pieces whereby the players attempt to match one of the second set of playing pieces with one of the first set of playing pieces;

a dispensing device for holding a plurality of said second set of playing pieces and dispensing the playing pieces randomly one at a time;

a plurality of payment playing pieces in the form of simulated coins, disposable into a slot in said dispensing device by the players of the game in payment for one of said second set of playing pieces; and means on said dispensing device for rendering an audible signal in response to one of said simulated coins being disposed therein.

7. The game combination of claim 6 wherein said dispensing device has an interior compartment for receiving said simulated coins, with said means for rendering an audible signal being disposed in said compartment, and biasing means within the compartment for impinging a simulated coin disposed therein against the audible signal means for actuating the same.

8. A game apparatus comprising, in combination:

a first set of playing pieces distributable in given numbers to plural players of the game, with different indicia on at least some of said first set of playing pieces;

a second set of playing pieces being visually distinguishable from said first set of playing pieces, with indicia on at least some of said second set of playing pieces corresponding to the indicia on said first set of playing pieces whereby the players attempt to match one of the second set of playing pieces with one of the first set of playing pieces;

a dispensing device for holding a plurality of said second set of playing pieces including a vertical compartment for receiving said second set of playing pieces stacked therein, and including ejecting means for removing the playing pieces one at a time from the bottom of the stack thereof; and a plurality of payment playing pieces disposable into said dispensing device by the players of the game in payment for one of said second set of playing pieces.

9. A game apparatus comprising, a combination:

a first set of playing cards in the form of a plurality of generally flat card-like objects with different indicia on at least one side of at least some of the cards of the first set thereof;

a second set of playing pieces being visually distinguishable from said first set of playing pieces, in the form of similarly shaped, but reduced in size, cards having corresponding indicia on at least one side of at least some of the cards of said second set thereof whereby the players of the game match the two sets of playing pieces by covering one of the cards of the first set by one of the cards of the second set;

a dispensing device for holding a plurality of said second set of playing pieces and a manually actuatable member movable between a receiving and a dispensing position for dispensing the playing pieces only one at a time; and a plurality of payment playing pieces disposable into said dispensing device by the players of the game in payment for one of said second set of playing pieces.

* * * * *